US009638009B2

(12) United States Patent
Kim

(10) Patent No.: US 9,638,009 B2
(45) **Date of Patent: *May 2, 2017**

(54) DOWNHOLE POWER GENERATION SYSTEM AND METHOD

(71) Applicant: Chevron U.S.A. Inc., San Ramon, CA (US)

(72) Inventor: Namhyo Kim, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 204 days.

This patent is subject to a terminal disclaimer.

(21) Appl. No.: 14/496,673

(22) Filed: Sep. 25, 2014

(65) Prior Publication Data

US 2016/0090819 A1 Mar. 31, 2016

(51) Int. Cl.
*E21B 41/00* (2006.01)

(52) U.S. Cl.
CPC ..... *E21B 41/0085* (2013.01)

(58) Field of Classification Search
CPC ..... E21B 41/0085
See application file for complete search history.

(56) References Cited

U.S. PATENT DOCUMENTS 5,839,508 A * 11/1998 Tubel ..... G01V 1/42 166/65.1
2008/0047753 A1* 2/2008 Hall ..... E21B 41/0085 175/57
2014/0069639 A1* 3/2014 Mackenzie ..... E21B 23/14 166/250.01

* cited by examiner

*Primary Examiner* — Kenneth L Thompson
*Assistant Examiner* — Steven MacDonald
(74) *Attorney, Agent, or Firm* — King & Spalding LLP

(57) ABSTRACT

A downhole power generation system includes a tubular power generation device configured to be disposed in an annular space around a portion of a production tubing, wherein the power generation device is switchable between a power generation mode and a bypass mode. The system also includes a power storage device electrically coupled to the tubular power generation device and configured to store power generated by the power generation device. The power generation device comprises at least one power generation path and at least one bypass path. The at least one power generation path comprises at least one power generation mechanism which generates power when traversed by fluid. The at least one power generation path is open in the power generation mode and closed in the bypass mode.

14 Claims, 6 Drawing Sheets

DOWNHOLE POWER GENERATION SYSTEM AND METHOD

RELATED APPLICATIONS

The present application is related to U.S. patent application Ser. No. 14/496,682, titled "System and Method for Autonomous Downhole Power Generation," and filed concurrently herewith; and U.S. patent application Ser. No. 14/496,688, titled "Downhole Power Generation System with Alternate Flow Paths," and filed concurrently herewith.

TECHNICAL FIELD

The present application relates to downhole power generation. Specifically, the present application relates to a downhole power generation system with a power generation mode and a bypass mode.

BACKGROUND

In certain downhole operations, power is needed to run various components of a downhole assembly. For example, power is needed to drive actuators for valves and other components, and to power various sensors and communication devices. In many cases, power is generated downhole via a downhole power generation device that is coupled to the downhole assembly. Some of the devices may be designed to use mechanical power from the fluid flow to generate electric power downhole such as the mechanisms using flow induced vibration, turbomachinery, and the like. However, when such power generation mechanism is designed to run continuously, it must endure a large amount of stress and wear. This leads to a short operating device life. This is a problem because maintenance of such devices is extremely difficult and often impossible, and the expected life of such devices is much shorter than the life of the well. Additionally, such power generation devices typically generate more power than is needed to carry out the functions of the downhole assembly. Thus, the stress and wear seen by the power generation mechanism in generating the excess power does not translate into increased utility.

SUMMARY

In general, in one aspect, the disclosure relates to an autonomous downhole power generation system. The system includes a tubular power generation device configured to be disposed in an annular space around a portion of a production tubing, wherein the power generation device is switchable between a power generation mode and a bypass mode. The system also includes a power storage device electrically coupled to the tubular power generation device and configured to store power generated by the power generation device. The power generation device comprises at least one power generation path and at least one bypass path. The at least one power generation path comprises at least one power generation mechanism which generates power when traversed by fluid. The at least one power generation path is open in the power generation mode and closed in the bypass mode. The power generation mechanism is isolated from the at least one bypass path.

In another aspect, the disclosure can generally relate to a downhole power generation system. The system includes a tubular power generation device comprising a first end and a second end, an outer profile and an inner profile extending between the first end and the second end. The inner profile defines a central orifice configured to receive a length of production tubing therethrough. The power generation device includes at least one power generation path extending from the first end to the second end, wherein the at least one power generation path comprises a fluid driven power generation mechanism disposed therein.

In another aspect, the disclosure can generally relate to a method of generating power in a downhole environment. The method includes switching a power generation device from a bypass mode to a power generation mode. The power generation device includes at least one power generation path extending between a first end of the power generation device and a second end of the power generation device. The at least one power generation path comprises a fluid driven power generation mechanism disposed therein, wherein the power generation mechanism generates power when fluid flows through the power generation path. The power generation device further includes at least one bypass path extending between the first end of the power generation device and the second end of the power generation device. The power generation path is open when the power generation device is in the power generation mode and closed in the bypass mode.

These and other aspects, objects, features, and embodiments will be apparent from the following description and the appended claims.

BRIEF DESCRIPTION OF THE DRAWINGS

The drawings illustrate only example embodiments of the present disclosure, and are therefore not to be considered limiting of its scope, as the disclosures herein may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements. In one or more embodiments, one or more of the features shown in each of the figures may be omitted, added, repeated, and/or substituted. Accordingly, embodiments of the present disclosure should not be limited to the specific arrangements of components shown in these figures.

DETAILED DESCRIPTION OF EXAMPLE EMBODIMENTS

Figure 1:
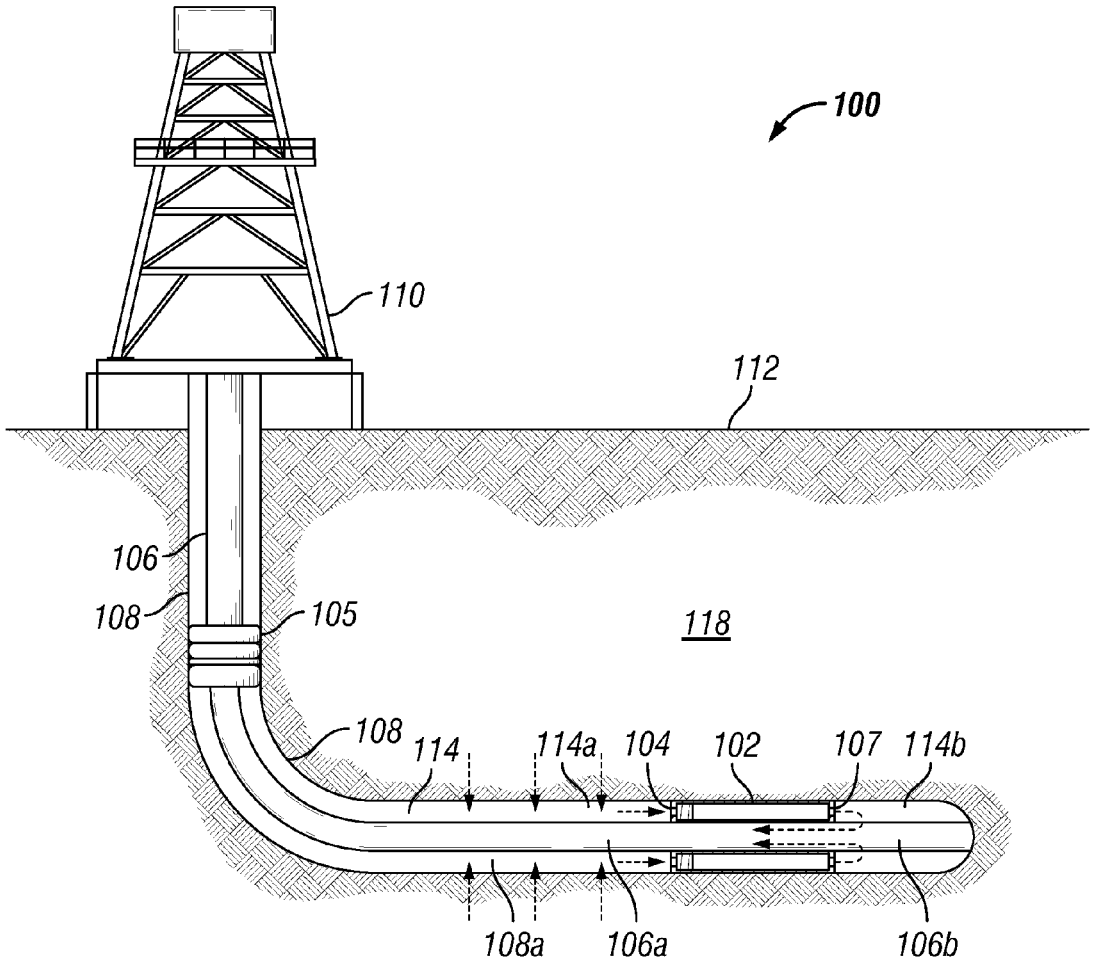
FIG. 1 illustrates a schematic diagram of a well site in which an autonomous downhole power generation system has been deployed, in accordance with example embodiments of the present disclosure.

Example embodiments directed to an autonomous downhole power generation system will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments disclosed herein may be practiced without these specific details. In other instances, well-known features have not been described in detail to avoid unnecessarily complicating the description. The example embodiments illustrated herein include certain components that may be replaced by alternate or equivalent components in other example embodiments as will be apparent to one of ordinary skill in the art.

Referring now to the drawings, FIG. 1 illustrates a schematic diagram of a well site 100 in which an autonomous downhole power generation system 102 has been deployed, in accordance with example embodiments of the present disclosure. In certain example embodiments, and as illustrated, the autonomous downhole power generation system 102 (hereinafter "power generation system") is deployed in a horizontal wellbore 108. The wellbore 108 is formed in a subterranean formation 118 and coupled to a rig 110 on a surface 112 of the formation 118. The formation 110 can include one or more of a number of formation types, including but not limited to shale, limestone, sandstone, clay, sand, and salt. The surface 112 may be ground level for an on-shore application or the sea floor for an off-shore application. In certain embodiments, a subterranean formation 110 can also include one or more reservoirs in which one or more resources (e.g., oil, gas, water, steam) are located. In certain example embodiments, the wellbore 108 is cased with cement of other casing material, which is perforated to allow fluids to flow from the formation 118 into the well 108. In certain example embodiments, the well 108 is a multi-zone well. A production tubing 106 is disposed downhole within the well 108. Fluids are recovered and brought to the rig 110 through the production tubing. In certain example embodiments, a production packer 105 is coupled to the production tubing 106.

Figure 2:
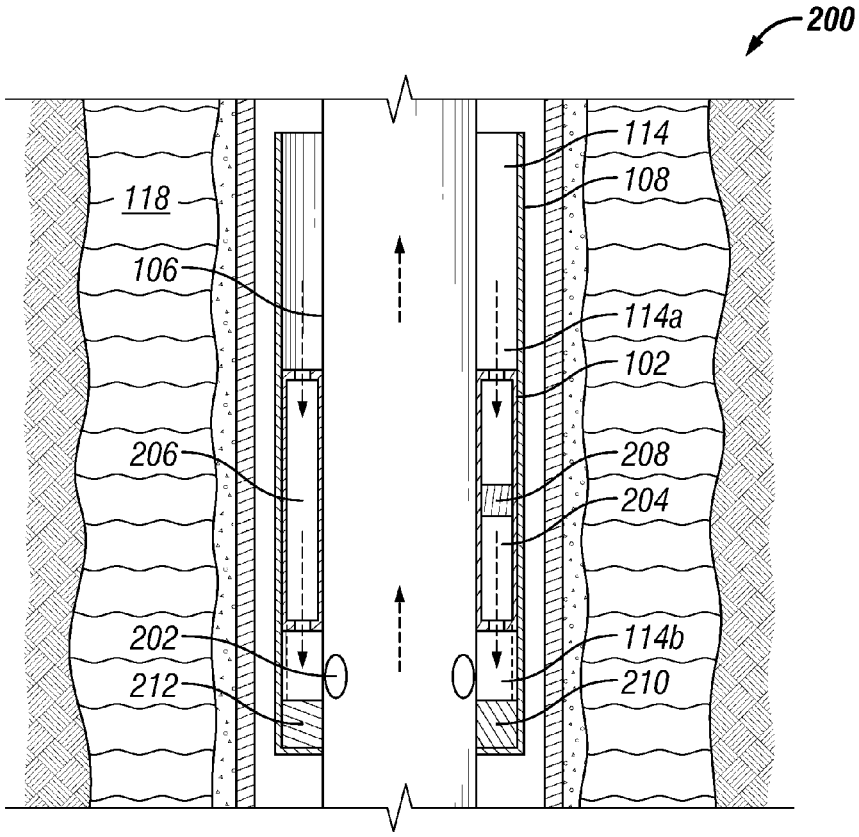
FIG. 2 illustrates a cross-sectional diagram of the downhole power generation system disposed around the production tubing, in accordance with example embodiments of the present disclosure.

In certain example embodiments, the power generation system 102 is disposed in an annular space 114 around a portion of the production tubing 106. FIG. 2 illustrates a cross-sectional diagram 200 of the power generation system 102 disposed around the production tubing 106, in accordance with example embodiments of the present disclosure. Referring to FIGS. 1 and 2, in certain example embodiments, the power generation system 102 is sealed between the production tubing 106 and the wellbore 108 such that fluid traveling from a first portion of the annular space 114*a* to a second portion 114*b* of the annular space is forced to travel through the power generation system 102, in which the first portion of the annular space 114*a* is adjacent a first end 104 of the power generation system 102 and the second portion of the annular space 114*b* is adjacent a second end 107 of the power generation system 102. In certain example embodiments, a portion of the wellbore 108 adjacent the first portion of the annular space 114*a* is perforated, allowing production fluid to flow into the first portion of the annular space 114*a*.

In certain example embodiments, a first portion of the production tubing 106*a* adjacent the first portion of the annular space 114*a* and the first end 104 of the power generation system 102 is not perforated, such that production fluid flowing into the first portion of the wellbore 108*a* does not flow directly into the first portion of the production tubing 106*a*. Rather, in certain example embodiments, the production fluid flowing to the first portion of the wellbore 108*a* is forced to flow through the power generation system 102 and into the second portion of the annular space 114*b*. In certain example embodiments, a second portion of the production tubing 106*b* adjacent the second portion of the annular space 114*b* contains flow control valves 202, which allow the production fluid to flow from the second portion of the annular space 114*b* into the production tubing 106. The production fluid can then travel to the surface 112 where it is recovered.

In certain example embodiments, the inside of the production tubing 106 is only in communication with the annular space 114 via the power generation system 102, and thus production fluid is forced to travel through the power generation system 102 in order to enter the production tubing 106 and ultimately be recovered. In certain example embodiments, flow of production fluid through the power generation system 102 allows the power generation system 102 to generate power, which is stored in a power storage device 210, such as a rechargeable battery, capacitor, or the like.

In certain example embodiments, and as best shown in FIG. 2, the power generation system 102 includes at least one power generation path 204 and at least one bypass path 206. In certain example embodiments, production fluid must travel through either the power generation path 204 or the bypass path 206 in order to enter the production tubing 106. In certain example embodiments, the power generation path 204 includes one or more power generation mechanisms 208 disposed therein, which generate power when traversed by the flow of production fluid. In certain example embodiments, the power generation mechanism 208 can include piezoelectric power generation elements, turbomachinery, or other electromagnetic power generation devices. Thus, these components are activated and energy is generated when production fluid flows through the power generation path 204.

In certain example embodiments, the bypass path 206 is isolated from the power generation mechanism 208 and provides a path for production fluid to flow through the power generation system 102 without interacting with the power generation mechanism 208. Thus, the power generation mechanism 208 is bypassed and does not generated power when fluid flows only through the bypass path 206.

Both the power generation path 204 and the bypass path 206 provide a path for the production fluid to travel through. In certain example embodiments, the power generation path 204 and the bypass path 206 can be opened and closed in order to direct production fluid through the selected path. In certain example embodiments, the bypass path 206 is closed when the power generation path 204 is open. Thus, production fluid must travel through the power generation path 204, engage with the power generation mechanism 208, and power is generated. Alternatively, in certain example embodiments, the bypass path 206 is opened when the power generation path 204 is closed. As such, production fluid flows through the bypass path 206 and the flow is isolated from the power generation mechanism 208. Thus, the power generation mechanism is not active. This allows the power generation mechanism to rest when power generation is not needed, which increases the overall life of the power generation mechanism.

In certain example embodiments, the power generation system 102 can be controlled to switch between a power generation mode and a bypass mode. Accordingly, when the power generation system 102 is in the power generation mode, the power generation path 204 is open, production fluid flows therethrough, activating the power generation mechanism 208, and power is generated. In certain example embodiments, the generated power is saved in the power storage device 210. The power stored in the power storage device can then be used to power various electronic parts of the downhole assembly, such as actuators, valves, sensors, communication modules, and other devices. When the power generation system 102 is in the bypass mode, the power generation path 204 is closed, production fluid flows through the bypass path 206, and power is not generated. In certain example embodiments, both the bypass path 206 and the power generation path 204 are open during the power generation mode. In certain example embodiments, at least one power generation path 204 is inter-connected to at least one bypass path 206 such that the flow passing through the power generation mechanism 208 can exit through the bypass paths 206.

In certain example embodiments, the power generation system 102 includes a control system 212, which includes various control components such as a microprocessor, sensors, controllers, and the like. In certain example embodiments, the control system 212 controls the switching of the power generation system 102 between the power generation mode and the bypass mode. In certain example embodiments, the control system 212 controls the switching based on one or more parameters or predetermined operational conditions. For example, in a first group of embodiments, the control system 212 controls the switching based on actual power demand by measuring the amount of power currently stored in the power storage device 210. In certain such embodiments, the control system 212 senses the current power level of the power storage device 210 via one or more sensors and compares the current power level to a first threshold level. If the measured power level is below the first threshold level, then the control system 212 switches the power generation system 102 into the power generation mode. In certain example embodiments, when the power generation system 102 is in the power generation mode, the control system 212 may switch the power generation system 102 to the bypass mode after a certain period of time, or when the measured power level of the power storage device 210 is above a second threshold value. In certain example embodiments, the second threshold value is higher than the first threshold value. Effectively, the power generation system 102 is used to generate power when the stored power is running relatively low and not used when the stored power is still relatively high, rather than continuously generating power regardless of actual demand. This reduces the amount of wear on the power generation mechanism 208, increasing the overall lifespan of the power generation system 102.

In a second group of example embodiments, not exclusive of embodiments in the first group, the control system 212 controls switching between the power generation mode and the bypass mode based on current operational conditions, operational demands, and/or a preprogrammed protocol. For example, in one embodiment, the control system 212 switches the power generation system 102 to the power generation mode in anticipation of a power-consuming event such as actuating a valve. In certain example embodiments, the power generation system 102 is put in the power generation mode during or after such an event. In certain example embodiments, the power generation system 102 is put in the bypass mode after such an event occurs. In certain example embodiments, the control system 212 switches the power generation system 102 to the power generation mode at certain time intervals. In certain example embodiments, the control system 212 is preprogrammed to control the power generation system 102 in accordance with a protocol or program. The protocol or program defines the conditions under which the power generation system 102 is to be put in the power generation mode and the conditions under which the power generation system 102 is to be put in the bypass mode. Such conditions may include stored power level, time interval, actuation, certain events, and so forth. This allows the power generation system 102 to autonomously switch between the power generation mode and bypass mode without intervention, and further allows the power generation system 102 to provide maximum utility and reduce waste.

In certain example embodiments, switching between the power generation mode and the bypass mode includes mechanical actuation, such as driving a motor, which mechanically opens and closes the power generation path 204 and the bypass path 206. In certain example embodiments, the switching includes expansion and contraction of a plug or packer type device in the power generation path 204 and the bypass path 206, in which the device blocks the respective path when expanded. In certain example embodiments, the power generation system 102 may operate in the bypass mode as a default when the control system 212, the power generation mechanism 208, or other necessary component fails or is out of commission.

Figure 3:
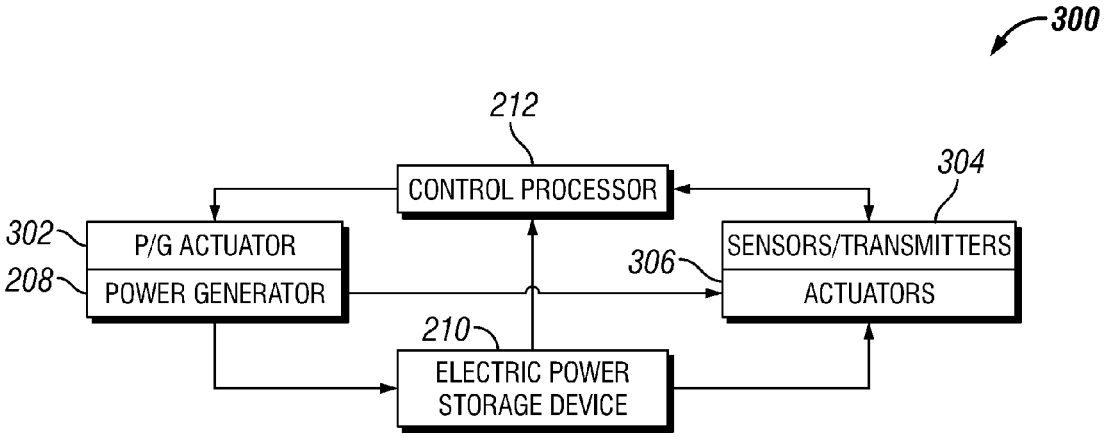
FIG. 3 illustrates a block diagram of the downhole power generation system, in accordance with example embodiments of the present disclosure.

FIG. 3 illustrates a block diagram 300 of the power generation system 102, in accordance with example embodiments of the present disclosure. In certain example embodiments, the block diagram 300 includes the control system 212, the power storage device 210, the power generator mechanism 208 which is coupled to a power generator actuator 302, and one or more actuators 306 and sensors or transmitters 304 that the downhole assembly may have. In certain example embodiments, the control system 212 sends control commands to the power generator actuator 302, which then actuates the power generator mechanism 208 accordingly. The power generator mechanism 208 generates power and sends the power to be stored in the power storage device 210. The power storage device 210 provides power to the control system 212, the actuators 306, and sensors and transmitters 304. In certain example embodiments, the control system 212 also controls and communicates with the sensors/transmitters 304 which are coupled to and communicate with the actuators 306. In certain example embodiments, the power storage device 210 provides a signal to the control system 212 indicative of the amount of power stored in power storage device 210.

Figure 5:
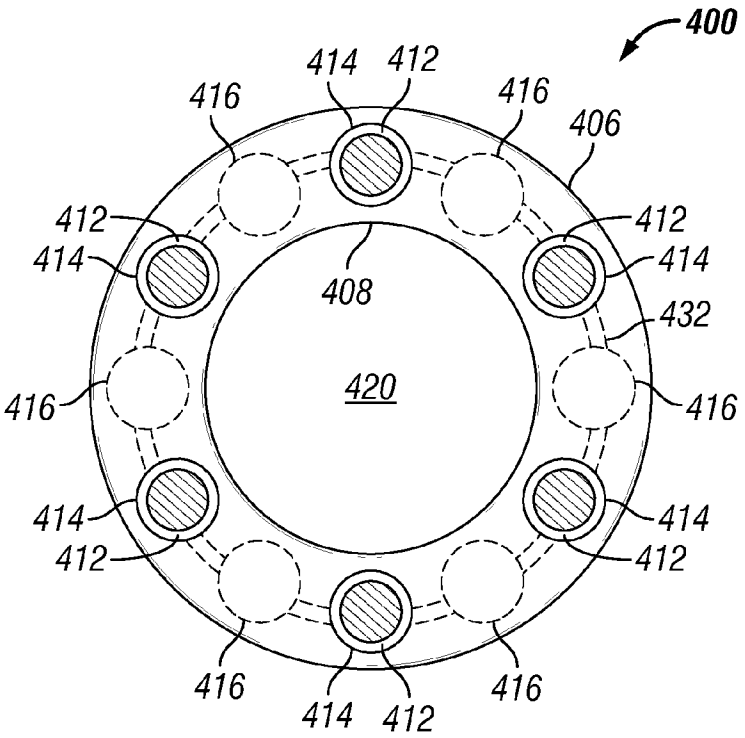
FIG. 5 illustrates a top view of the downhole power generation device set in the power generation mode, in accordance with example embodiments of the present disclosure.
Figure 4:
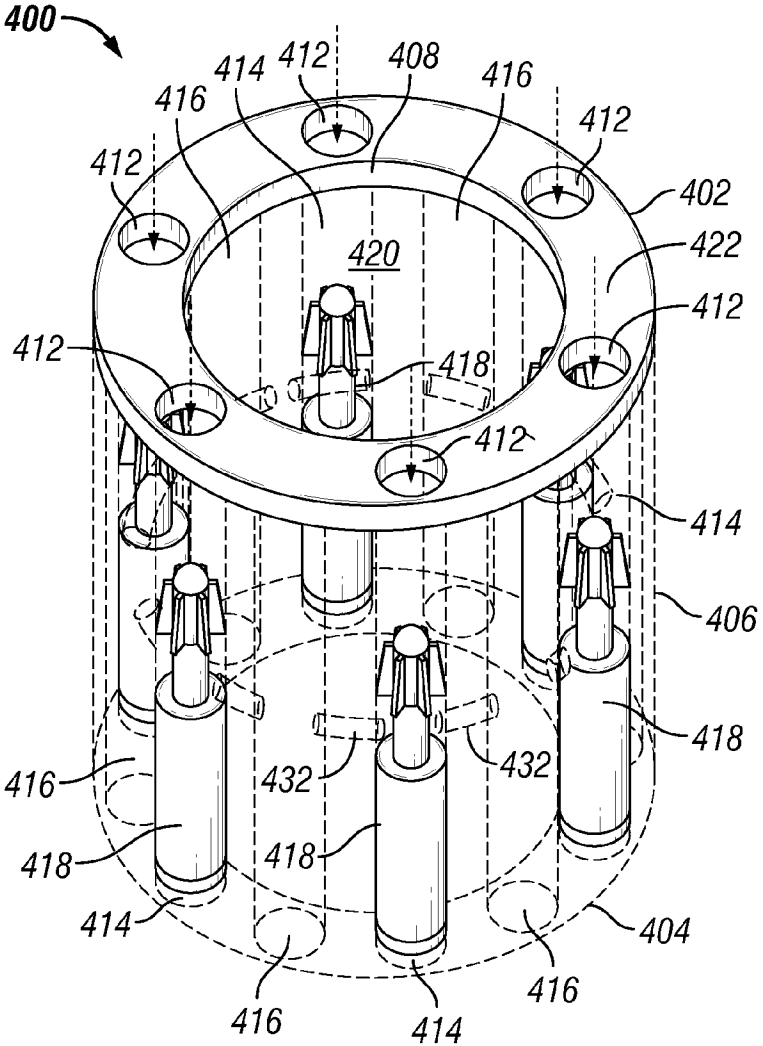
FIG. 4 illustrates a perspective view of a downhole power generation device set in a power generation mode, in accordance with example embodiments of the present disclosure.

FIG. 4 illustrates a perspective view of a downhole power generation device 400 in the power generation mode and FIG. 5 illustrates a corresponding top view, in accordance with example embodiments of the present disclosure. Referring to FIGS. 4 and 5, the device 400 has a generally tubular shape and includes a first end 402 and a second end 404. The device 400 is further defined by an outer profile 406 and an inner profile 408, each of which extend from the first end 402 to the second end 404. The inner profile 408 defines a central opening 420 through which the production tubing is disposed. In certain example embodiments, at least one of the first end 402, the second end 404, or the inner profile forms a fluid tight seal around a portion of the production tubing. Likewise, in certain example embodiments, at least one of the first end 402, the second end 404, or the outer profile 406 forms a fluid tight seal against the wellbore 108 or casing in which the device 400 is disposed. In certain example embodiments, the power generation device 400 includes one or more power generation paths 414 and at least one bypass path 416.

Figure 8:
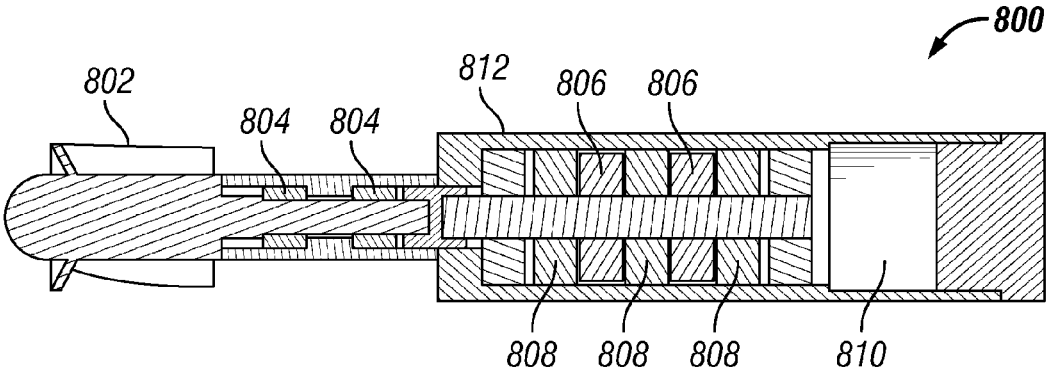
FIG. 8 illustrates a cross-sectional view of an exemplary power generation mechanism, in accordance with example embodiments of the present disclosure.

In certain example embodiments, the power generation path 414 is defined by an orifice traversing the power generation device 400 and contained between the outer profile 406 and the inner profile 408. In certain example embodiments, the orifice is tubular shaped and extends between the first end 402 and the second end 404. In certain example embodiments, the power generation path 414 provides an open path between the first end 402 and the second end 404. In certain example embodiments, the power generation path 414 includes a power generation mechanism 418 disposed therein. In the illustrated example embodiment, the power generation mechanism 418 is a turbomachinery component, an example embodiment of which is illustrated in FIG. 8. Referring to FIG. 8, the turbomachinery component 800 includes one or more turbine blades 802, one or more bearings 804, one or more rotating permanent magnets 806, one or more static coils 808, and an electronics module 810, all of which is housed in a body 812. As fluid flows past, the turbine blades 802 are rotated or spun, which causes the rotating permanent magnets 806 to rotate with respect to the static coils 808. This causes electrons inside the coils 808 to flow, thereby generating electricity. In certain example embodiments, the power generation path 414 is configured to receive a flow of fluid traversing therethrough. The fluid flow engages with and turns the turbomachinery as it traverses the power generation path 414. As described, turning of the turbomachinery generates power, which is stored in the power storage device 210 for future use. In certain example embodiments, the power generation device 400 includes a plurality of power generation paths 414 formed therein and disposed around the central opening 420 as illustrated in FIG. 4. The number and size of power generation paths 414 as well as the number and size of the power generating mechanism 418 can be determined based on the amount of power suitable for the application and other application or well specific parameters.

In certain example embodiments, the bypass path 416 is defined by an orifice traversing the power generation device 400 and contained between the outer profile 406 and the inner profile 408. In certain example embodiments, the orifice is tubular shaped and extends between the first end 402 and the second end 404. In certain example embodiments, the bypass path 416 is generally isolated from the power generation path 414. In certain example embodiments, the bypass path 416 provides an open path between the first end 402 and the second end 404. In certain example embodiments, the bypass path 416 is configured to receive a flow of fluid but does not include a power generation mechanism 418. In certain example embodiments, the power generation device 400 includes a plurality of bypass paths 416 formed therein and disposed around the central opening 430 as illustrated in FIG. 4. In certain example embodiments, a plurality of power generation paths 414 and a plurality of bypass paths 416 are disposed alternatingly around the central opening 420 and between the inner profile 408 and the outer profile 406 of the power generation device 400. In certain example embodiments, the power generation paths 414 and the bypass paths 416 can be straight, bent, or curved, and can have circular, polygonal, or non-geometric cross-sectional shapes. The power generation paths 414 and the bypass paths 416 can have any kind of shape that places the first end 402 and the second end 404 in fluid communication. In certain example embodiments, at least one of the power generation paths 414 may be inter-connected to at least one of the bypass paths 416 by the inter-connection ports 432 such that the flow passing power generation mechanism 418 can exit through the bypass paths 416.

Figure 7:
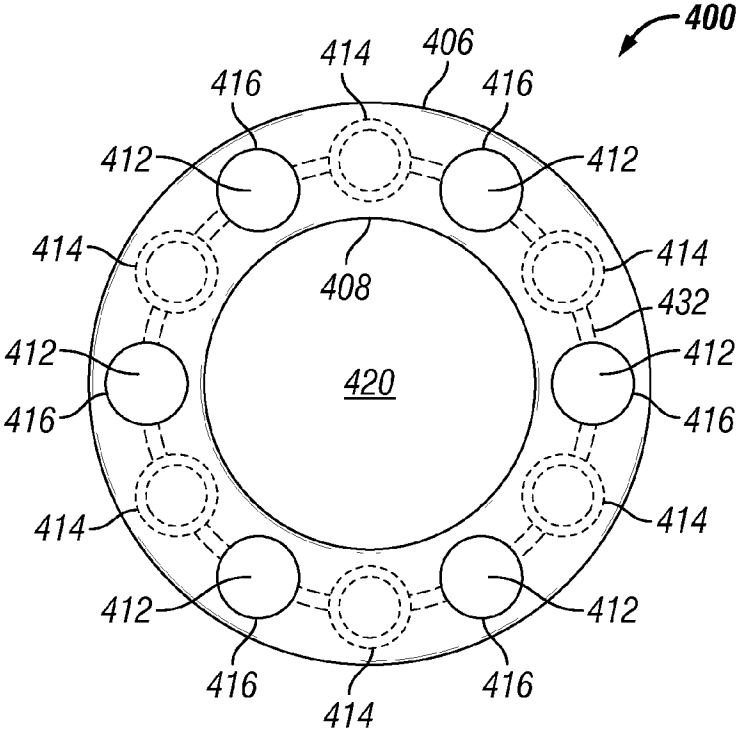
FIG. 7 illustrates a top view of the downhole power generation device set in the bypass mode, in accordance with example embodiments of the present disclosure.
Figure 6:
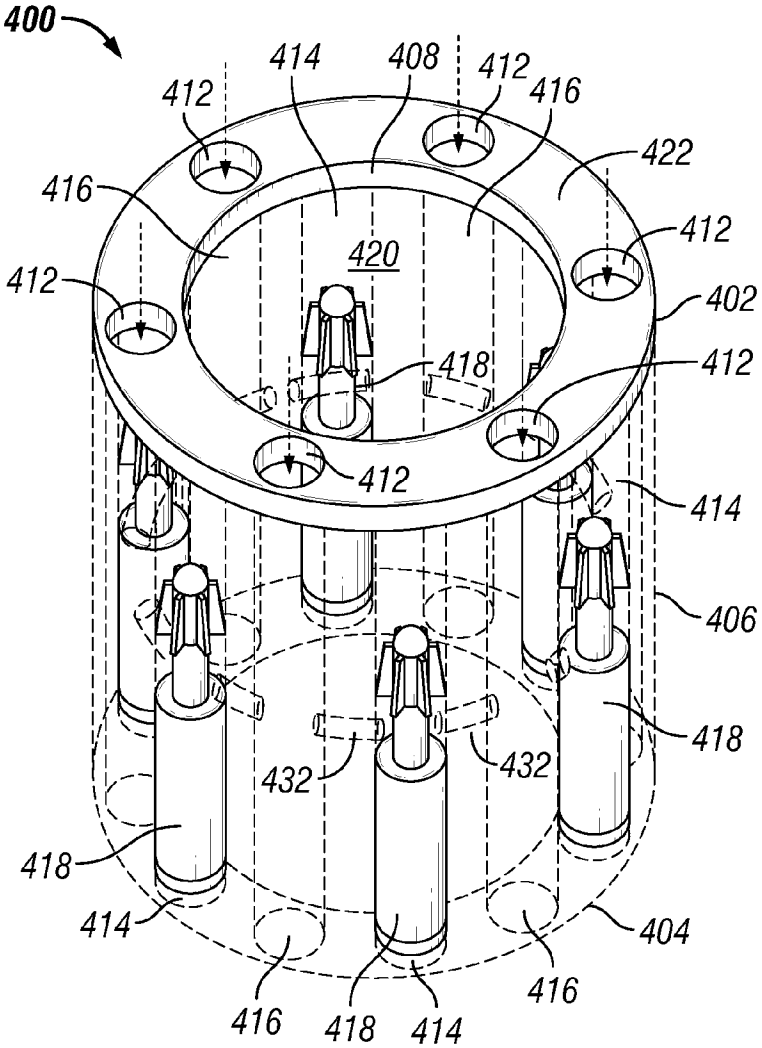
FIG. 6 illustrates a perspective view of the downhole power generation device set in a bypass mode, in accordance with example embodiments of the present disclosure.

In certain example embodiments, the power generation device 400 includes a selector ring 422 disposed on the first end 402 and over the power generation paths 414 and the bypass paths 416. In certain example embodiments, the selector ring 422 includes a solid surface with one or more openings 412 formed therein. In certain example embodiments, the selector ring 422 is orientable with respect to the power generation and bypass paths 414, 416. When the power generation system is in the power generation mode, the selector ring 422 is oriented such that the one or more openings 412 are aligned with the one or more power generation paths 414, placing an environment adjacent to the selector ring 422 in fluid communication with the power generation paths 414 and an environment adjacent to the second end 404. Thus, when deployed downhole and during operation, production fluid flows through the power generation device 400 via the power generation path 414, generating power. In certain example embodiments, when the openings 412 are aligned with the power generation paths 414, the solid surface of the selector ring 422 covers the bypass paths 416, sealing off the bypass paths 416 from an environment adjacent the selector ring 422. Thus, the production fluid is blocked from the bypass paths 416 and forced to flow through the power generation paths 414. Alternatively, FIG. 6 illustrates a perspective view of the downhole power generation device 400 in the bypass mode and FIG. 7 illustrates a corresponding top view, in accordance with example embodiments of the present disclosure. With reference to FIGS. 6 and 7, when the power generation system is in the bypass mode, the selector ring 422 is oriented such that the one or more openings 412 are aligned with the one or more bypass paths 416, placing an environment adjacent to the selector ring 422 in fluid communication with the bypass paths 416 and an environment adjacent to the second end 404. In certain example embodiments, when the openings 412 are aligned with the bypass paths 416, the solid surface of the selector ring 422 covers the power generation paths 414, sealing off the power generation paths 414 from an environment adjacent the selector ring 422. Thus, the production fluid is blocked from entering the power generation paths 414 and forced to flow through the bypass paths 416. In this bypass mode, production fluid does not engage the power generation mechanism 418 and power is not produced. Such periods of inoperation reduce the wear on the power generation mechanism 418, thereby extending the life of the device.

In certain example embodiments, the downhole power generation device 400 can switch between being in the power generation mode, as illustrated in FIG. 4, and being in the bypass mode, as illustrated in FIG. 6 by turning the selector ring 422 from a first position to a second position, respectively. In certain example embodiments, the selector ring 422 is moved by an actuation device such as a small motor. The motor may receive control signals from the control system 212 and drive accordingly. In certain example embodiments, instead of having a selector ring 422, each power generation path 414 and each bypass path 416 may be covered by a retractable cover (not shown), which retract according to the operational mode. For example, when the device 400 is in the power generation mode, the covers of each of the power generation path 414 are retracted, leaving the power generation paths 414 open. Accordingly, the bypass paths 416 remain covered in this mode.

Figure 9:
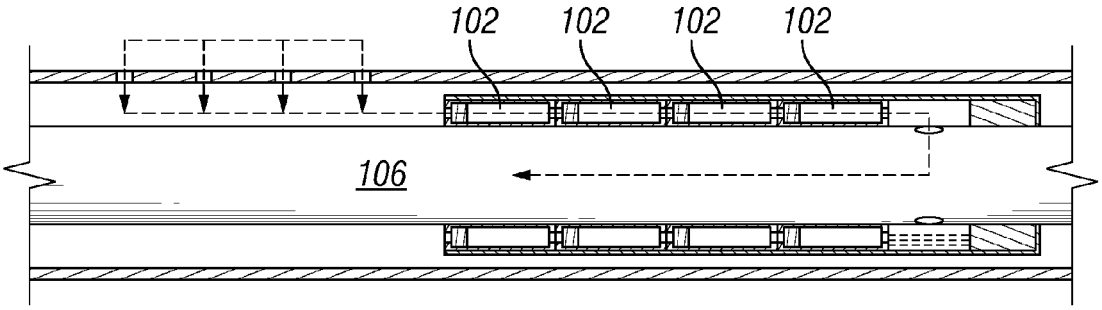
FIG. 9 illustrates a diagram of a plurality of downhole power generation systems coupled in series, in accordance with example embodiments of the present disclosure.

FIG. 9 illustrates a plurality of power generation systems 102 stacked together in series, in accordance with example embodiments of the present disclosure. In such example embodiments, a plurality of power generation systems 102 can be placed adjacent each other such that production fluid is forced to traverse each of the power generation systems 102. In certain example embodiments, each power generation system 102 is couplable to another power generation system 102. Such a configuration can generate more power than a single power generation system 102, and may be advantageous when a large amount of power is needed.

Figure 10:
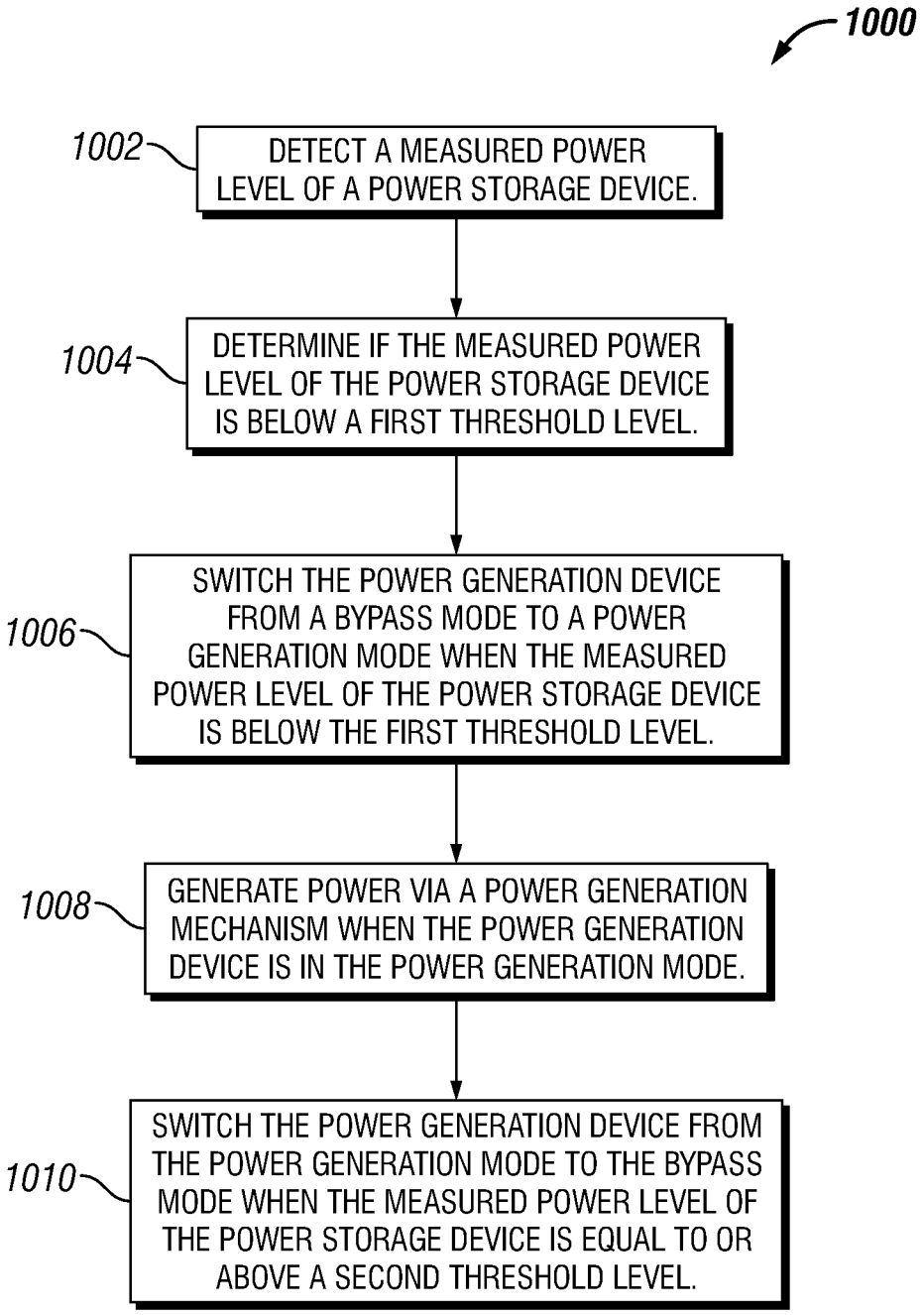
FIG. 10 illustrates a method of using a power generation system, in accordance with the example embodiments of the present disclosure.

FIG. 10 illustrates a method 1000 of using a power generation system, in accordance with the example embodiments of the present disclosure. In certain example embodiments, controlling of the power generation system 102 is performed by the control system 212 of the power generation system 102 and includes switching between operating the power generation system 102 in the power generation mode and operating the power generation system 102 in the bypass mode. Referring to FIG. 10, the method 1000 includes detecting the current power level of a power storage device 210 (step 1002). In certain example embodiments, the control system 212 is coupled to a sensor or electrical connection which senses the amount of power stored in the power storage device 210 and receives the value as data. The method 1000 further includes determining if the measured power level of the power storage device is below a first threshold level (step 1004), and switching the power generation device from a bypass mode to a power generation mode when the measured power level of the power storage device 210 is below the first threshold level (step 1006). In certain example embodiments, the power generation device 210 is switched into the power generation mode when another activation condition, besides falling below the first threshold level, is met. Thus, the power generation path 204 is opened and production fluid is directed to flow therethrough, engaging the power generation mechanism 208 and generating power (step 1008). In certain example embodiments, the method 1000 includes switching the power generation system 102 from the power generation mode to the bypass mode when the measured power level of the power storage device 210 is equal to or greater than a second threshold value (step 1010). In certain example embodiments, the second threshold value represents the full charge capacity of the power storage device. In certain example embodiments, the power generation device 210 is switched into the bypass mode when another deactivation condition is met.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A downhole power generation system, comprising:

a tubular power generation device configured to be disposed in an annular space around a portion of a production tubing, wherein the power generation device is switchable between a power generation mode and a bypass mode;

a power storage device electrically coupled to the tubular power generation device and configured to store power generated by the power generation device;

wherein the power generation device comprises at least one power generation path and at least one bypass path, wherein the at least one power generation path comprises at least one power generation mechanism which generates power when traversed by fluid;

wherein the at least one power generation path is open in the power generation mode; and wherein the at least one power generation path is closed in the bypass mode and the power generation mechanism is isolated from the at least one bypass path.

2. The downhole power generation system of claim 1, further comprising:

a control processor communicatively coupled to the power storage device and the power generation device, wherein the control processor receives a measure of power stored in the power storage device and switches the power generation device between the power generation mode and the bypass mode based on the measure of power.

3. The downhole power generation system of claim 1, wherein the at least one power generation mechanism comprises at least one turbomachinery component.

4. The downhole power generation system of claim 1, further comprising a selector ring, the selector ring comprising a solid surface and at least one opening, wherein the at least one opening aligns with the at least one power generation path and the solid surface covers an opening of the at least one bypass path when the power generation device is in the power generation mode.

5. The downhole power generation system of claim 1, wherein a production fluid flows through the at least one power generation path when the power generation device is in the power generation mode, and the production fluid flows through the at least one bypass path when the power generation device is in the bypass mode.

6. The downhole power generation system of claim 1, wherein at least one of the power generation paths and the bypass paths is a tubular orifice formed in the power generation device.

7. The downhole power generation system of claim 1, wherein at least one of the power generation paths is inter-connected to at least one of the bypass paths.

8. A downhole power generation system, comprising:

a tubular power generation device comprising a first end and a second end, an outer profile and an inner profile extending between the first end and the second end, the inner profile defining a central orifice configured to receive a length of production tubing therethrough, the power generation device comprising:

at least one power generation path extending from the first end to the second end, the at least one power generation path comprising a fluid driven power generation mechanism disposed therein, wherein the power generation device further comprises:

at least one bypass path extending from the first end to the second end, the at least one bypass path isolated from the at least one power generation path, wherein the tubular power generation device is switchable between a power generation mode and a bypass mode, the power generation path being open in the power generation mode and closed in the bypass mode.

9. The downhole power generation system of claim 8, wherein a production fluid enters the power generation device via the first end and exits the power generation device via the second end.

10. The downhole power generation system of claim 8, wherein the at least one power generation mechanism comprises at least one turbomachinery component.

11. The downhole power generation system of claim 8, further comprising:

a selector mechanism disposed on the first end of the tubular power generation device, wherein the selector mechanism opens the power generation path when the device is in the power generation mode and closes the power generation path when the device is in the bypass mode.

12. The downhole power generation system of claim 8, wherein the power generation device forms a fluid tight seal about a production tubing and against a wellbore or casing.

13. The downhole power generation system of claim 8, wherein at least one of the power generation paths and the bypass paths is a tubular orifice formed in the power generation device between the outer profile and the inner profile.

14. The downhole power generation system of claim 8, wherein a production fluid flows through the at least one power generation path when the power generation device is in the power generation mode, and the production fluid flows through the at least one bypass path when the power generation device is in the bypass mode.

* * * * *